US007708421B2

(12) United States Patent
Underdown et al.

(10) Patent No.: US 7,708,421 B2
(45) **Date of Patent: *May 4, 2010**

(54) ILLUMINATED ARTICLES OF ADORNMENT

(76) Inventors: William C. Underdown, 149 NW. 70th St., Suite 213, Boca Raton, FL (US) 33487; Janet L. Falbo, 149 NW. 70th St., Suite 213, Boca Raton, FL (US) 33487

( * ) Notice: Subject to any disclaimer, the term of this patent is extended or adjusted under 35 U.S.C. 154(b) by 0 days.

This patent is subject to a terminal disclaimer.

(21) Appl. No.: 12/258,510

(22) Filed: Oct. 27, 2008

(65) Prior Publication Data

US 2009/0044566 A1 Feb. 19, 2009

Related U.S. Application Data

(63) Continuation-in-part of application No. 11/436,938, filed on May 18, 2006, now Pat. No. 7,441,917.

(60) Provisional application No. 60/682,363, filed on May 18, 2005.

(51) Int. Cl.
*A44C 5/00* (2006.01)

(52) U.S. Cl. ..... 362/104; 362/103

(58) Field of Classification Search ..... 362/103, 362/104

See application file for complete search history.

(56) References Cited

U.S. PATENT DOCUMENTS

| | | | | |
|---|---|---|---|---|
| 6,233,971 | B1 | 5/2001 | Ohlund | |
| 6,601,965 | B2 | 8/2003 | Kamara | |
| 7,104,668 | B1 | 9/2006 | Lee | |
| 7,441,917 | B1 * | 10/2008 | Underdown et al. | 362/103 |

* cited by examiner

*Primary Examiner*—Anabel M Ton
(74) *Attorney, Agent, or Firm*—Mark D. Bowen, Esq.; Malin Haley DiMaggio Bowen & Lhota, P.A.

(57) ABSTRACT

An illuminated article of adornment, such as jewelry, having a conductor loop, a magnetically connectable clasp housing a removable battery, and a medallion having internal light emitting diode ("LED"). The clasp consists of two magnetically connectable clasp components, at least one of which is adapted with an interior chamber for containing a battery power source. Each clasp component includes a vertex end connected to an electrical conductor, and a magnetically attractable base. At least one of the clasp components contains a magnet thereby allowing the clasp components to be magnetically connectable in base-to-base relation without requiring precise manual alignment. No further mechanical connection is required. Once connected the clasp completes an electrical circuit resulting in the illumination of an LED electrically connected to the necklace opposite the clasp portion. The LED is preferably connected to or embedded within a crystal to enhance the illumination effect.

10 Claims, 15 Drawing Sheets

ILLUMINATED ARTICLES OF ADORNMENT

CROSS REFERENCE TO RELATED APPLICATIONS

This application is a continuation-in-part of U.S. patent application Ser. No. 11/436,938, filed May 18, 2006, which claims the benefit of provisional U.S. Patent Application Ser. No. 60/682,363, filed on May 18, 2005.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

The present invention relates to articles of adornment such as jewelry, and more particularly to a jewelry items, such as a necklace or bracelet, and more particularly to jewelry items or other items of adornment, having an electrically powered light-emitting device for providing an illumination effect.

2. Description of Related Art

The market for jewelry is substantial and diverse. As a result, there exist a wide variety of jewelry designs. For example, jewelry designs span a large range from simple to complex, and from expensive fine jewelry pieces to less expensive costume jewelry pieces. Among these designs are several lighted jewelry pieces including illuminated earrings and lighted pendants.

U.S. Pat. No. 6,601,965, issued to Kamara, discloses a necklace having an illuminated medallion with a conductor loop coated with non-conductive material, and connected to the conductor loop a clasp that houses a removable battery, and a bead having and internally embedded LED. The prior art necklace disclosed by Kamara is depicted herein in FIGS. 1-3, and is burdened by significant disadvantages. More particularly, the clasp consists of two generally cylindrical pieces require the user to manipulate the pieces into a press fit configuration as depicted in FIGS. 2 and 3. The clasp is thus not only difficult to connect, but results in misalignment of the necklace/conductor ends when in the connected configuration.

U.S. Pat. No. 6,122,933, issued to Ohlund, discloses a jewelry piece having a loop conductor with an LED and a clasp housing a battery. The clasp disclosed by Ohlund has similar disadvantages to that disclosed by Kamara. More particularly, the Ohlund clasp requires the user to make a threaded connection and results in misalignment of the necklace/conductor ends.

Accordingly, there exists a need for illuminated jewelry having an improved clasp that is easily connected and results in alignment of the necklace ends.

BRIEF SUMMARY OF THE INVENTION

The present invention overcomes the disadvantages in the art by providing an improved an illuminated Jewelry article having a conductor loop, a magnetically connectable clasp housing a removable battery, and a medallion having internal light emitting diode ("LED"). The clasp consists of two magnetically connectable clasp components, at least one of which is adapted with an interior chamber for containing a battery power source. Each clasp component includes a vertex or tapered end connected to an electrical conductor, and a magnetically connectable base. At least one of the clasp components contains a magnet thereby allowing the clasp components to be magnetically connectable in base-to-base relation without requiring precise manual alignment. No further mechanical connection is required. Once connected, the clasp completes an electrical circuit resulting in the illumination of an LED electrically connected to the necklace generally opposite the clasp portion. The LED is preferably connected to or embedded within a crystal to enhance the illumination effect. The conductor loop may include an external coil that functions to maintain the electrical conductor—running from the clasp section to the pendant section—in a generally arcuate configuration.

Accordingly, it is an object of the present invention to provide improvements in the field of illuminating jewelry.

Still another object of the present invention is to provide an improved clasp for jewelry.

Yet another object of the present invention is to provide a magnetically connectable clasp for jewelry.

Another object of the present invention is to provide an illuminated necklace having a magnetically connectable clasp.

Still another object of the present invention is to provide such a jewelry item wherein the clasp further functions as a battery housing.

Another object of the present invention is to provide an illuminated necklace having an improved conductor assembly that maintains the necklace in a generally arcuate shape while resisting crimping or kinking.

In accordance with these and other objects, which will become apparent hereinafter, the instant invention will now be described with particular reference to the accompanying drawings.

DETAILED DESCRIPTION OF THE INVENTION

Figure 1:
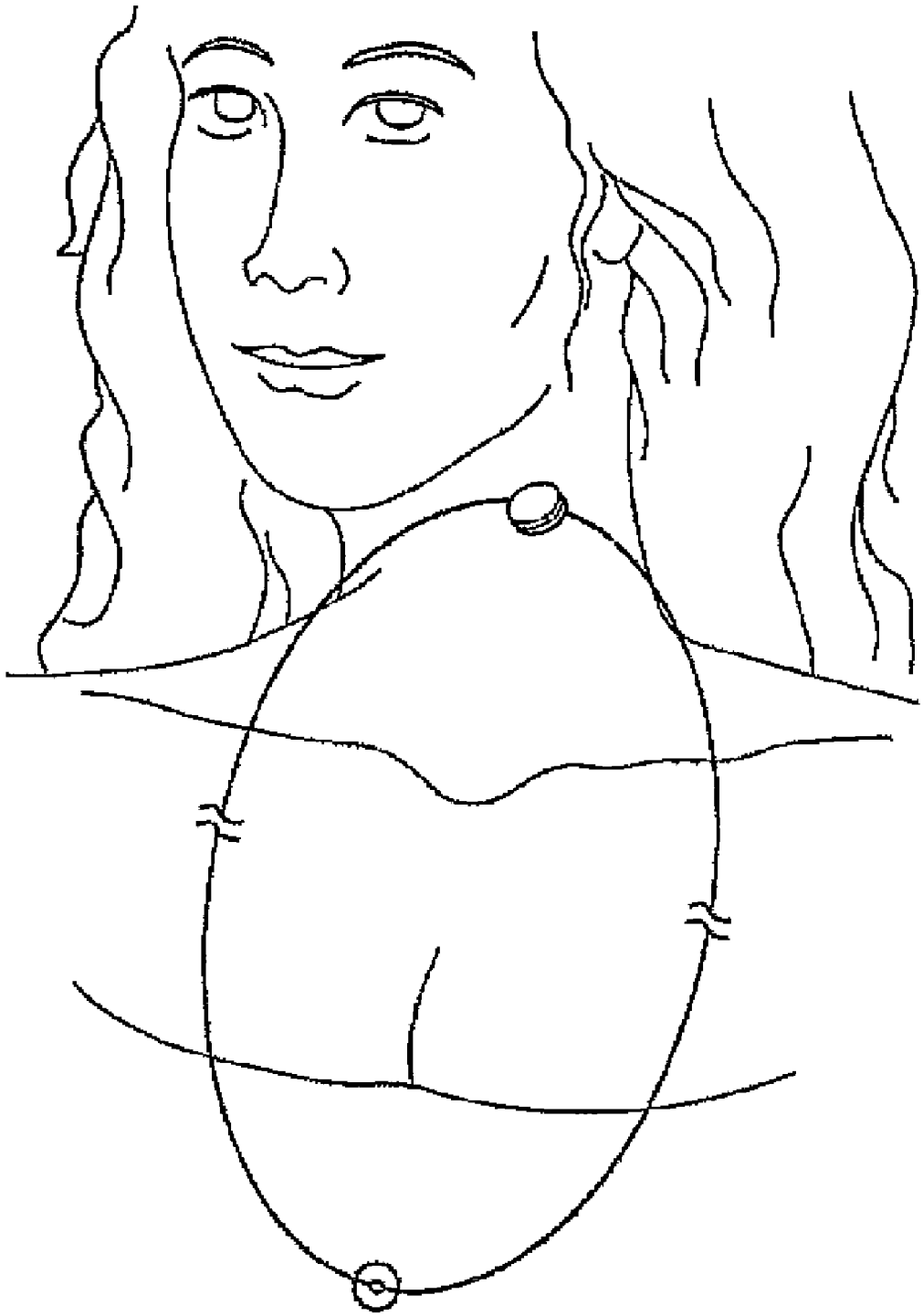
FIG. 1 PRIOR ART
FIG. 1 shows a prior art illuminated necklace.
Figure 2:
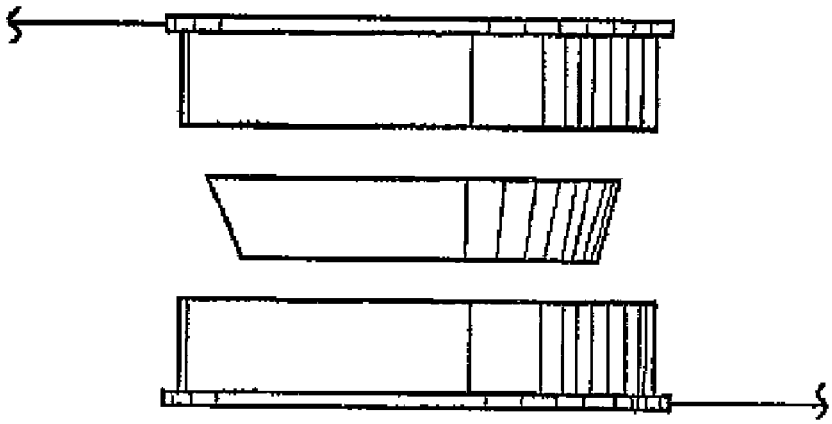
FIG. 2 PRIOR ART
FIGS. 2 and 3 depict detailed views of a press fit clasp for use with the prior art illuminated necklace.
Figure 3:
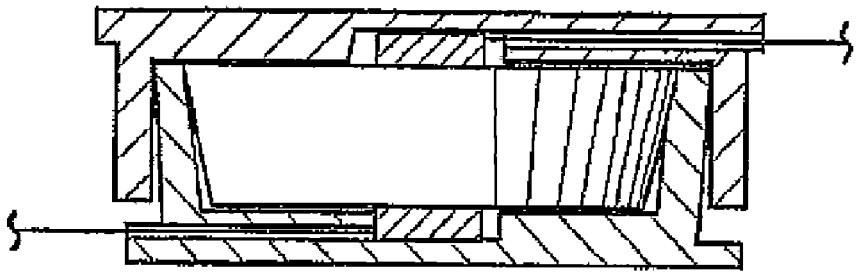
FIG. 3 PRIOR ART
Figure 4:
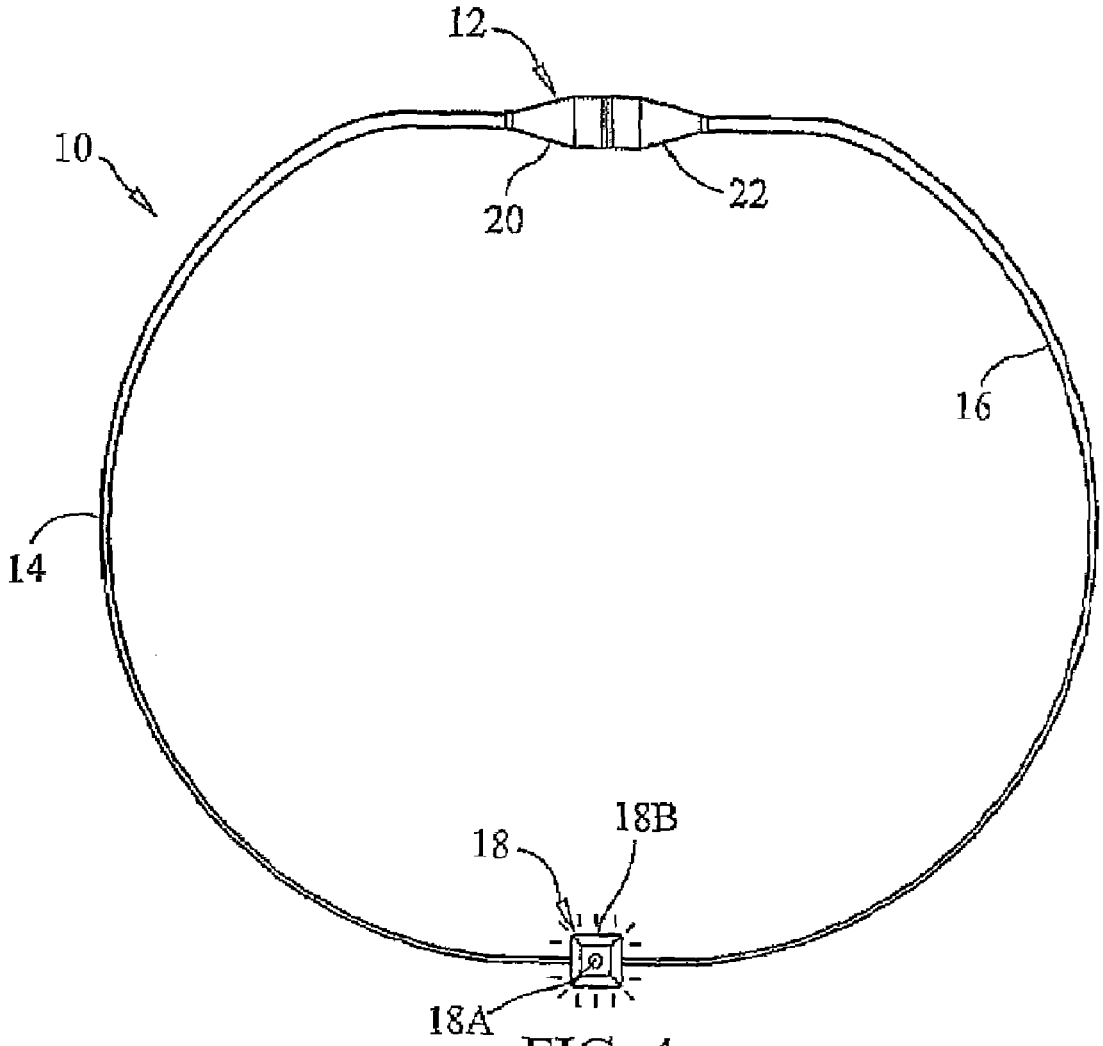
FIG. 4 depicts an illuminated necklace in accordance with the present invention.

With reference now to the drawings there is depicted an illuminated necklace 10 in accordance with the present invention. FIGS. 1-3 depict an illuminated necklace in accordance with the prior art. FIG. 4 depicts an illuminated necklace 10 in accordance with the present invention. Necklace 10 includes a clasp 12 having at least one internal battery compartment, electrical conductor assemblies, generally referenced as 14 and 16, connected to clasp 12, and an illuminated medallion 18 adapted with a light emitting device connected to conductor assemblies, generally referenced as 14 and 16, for providing illumination. Conductor assemblies 14 and 16 thus combine to form a loop conductor having first and second discontinuities, with clasp 12 located within the first discontinuity and medallion 18 located within the second discontinuity. As used herein the term "medallion" means the article or assembly attached to the necklace generally opposite the clasp, namely the decorative element that is normally positioned on the wearer's chest, and is intended to cover any suitable shape, such as a cube, figurine, number, letter, symbol, useful article, or decorative element.

Figure 5:
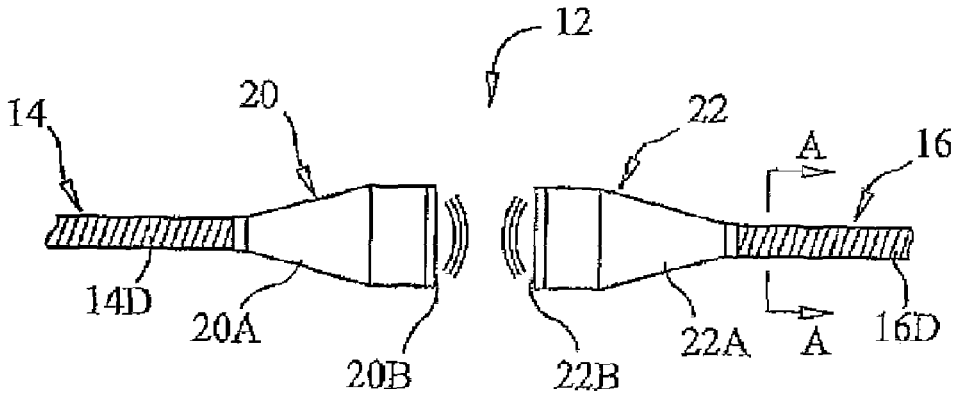
FIG. 5 is a partial detailed view of the combination battery compartment and magnetic clasp assembly in un-clasped/spaced relation.
Figure 6:
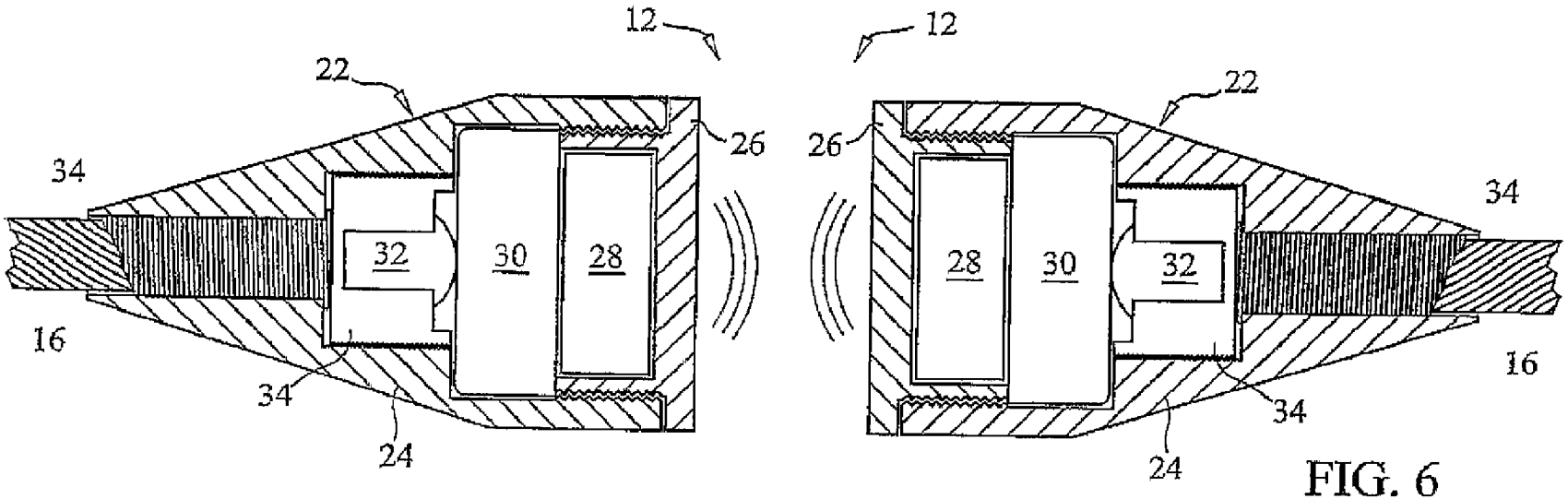
FIG. 6 is a detailed sectional view thereof in an un-clasped configuration.
Figure 7:
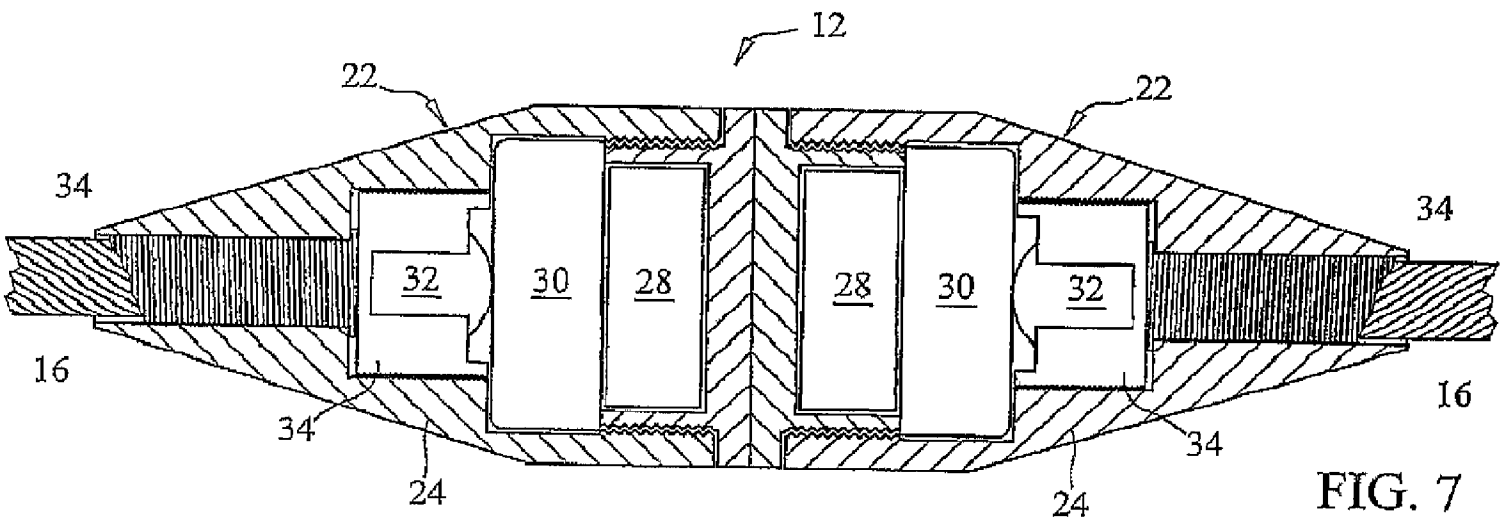
FIG. 7 is a detailed sectional view thereof in a clasped configuration.
Figure 8:
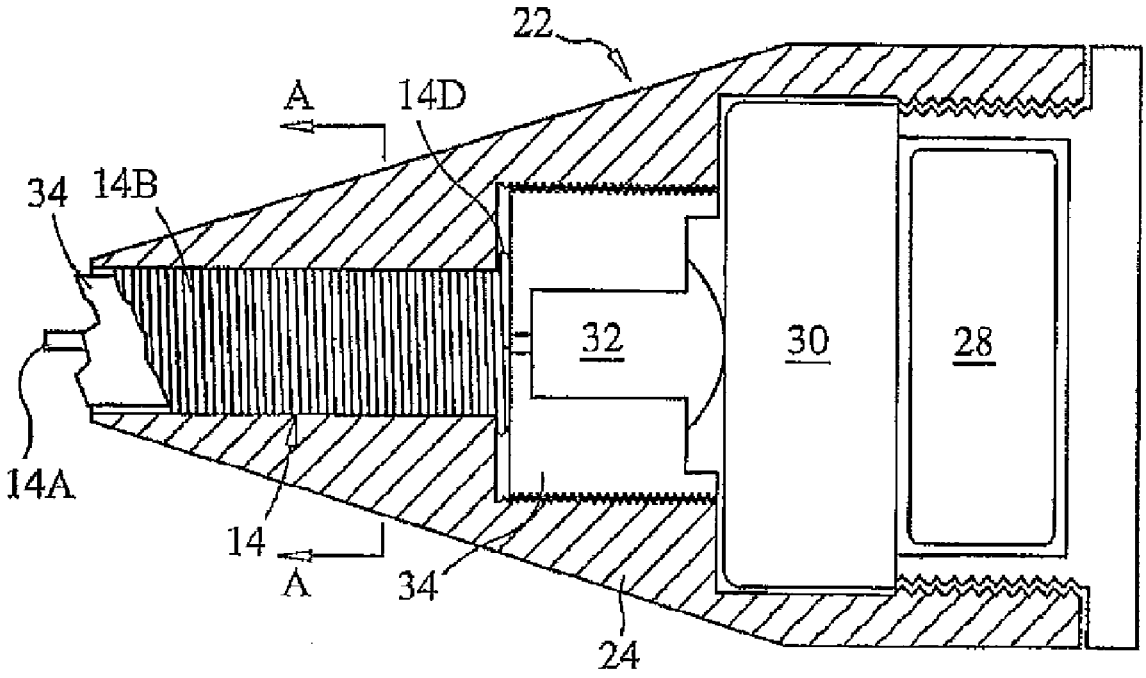
FIG. 8 is a detailed sectional view of a magnetic clasp end.
Figure 8A:
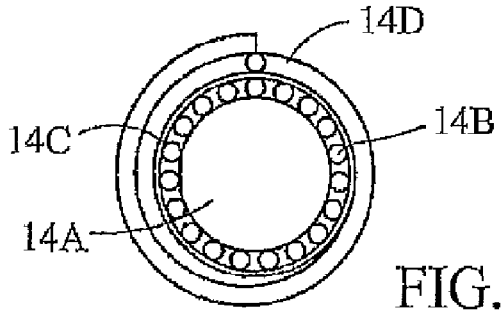
FIG. 8A is a sectional view of the conductor assembly taken along line A-A in FIG. 8.
Figure 9:
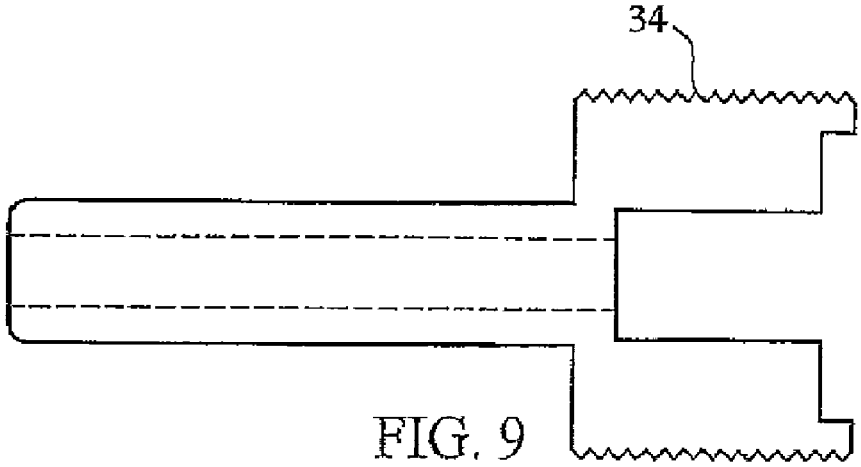
FIG. 9 depicts a conductor retaining sleeve of the magnetic clasp.
Figure 10:
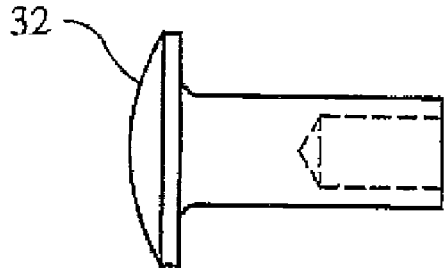
FIG. 10 depicts a conductor end fitting.
Figure 11:
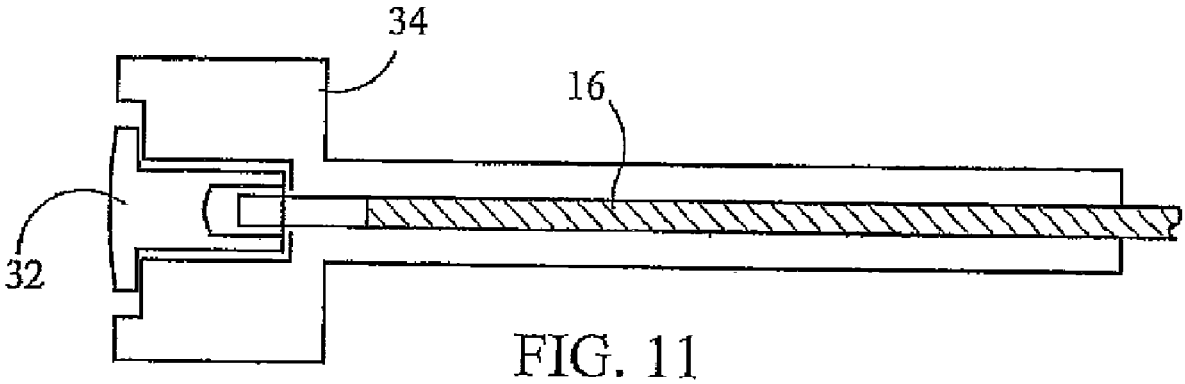
FIG. 11 depicts a wire adapted with a conductor end fitting received within a conductor retaining sleeve.
Figure 12:
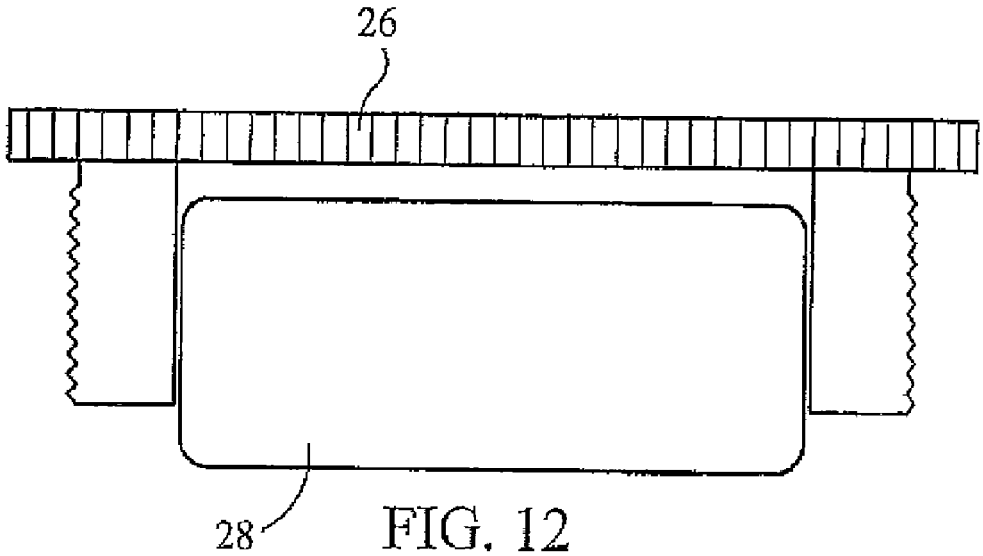
FIG. 12 depicts a threaded magnetic clasp end connector and magnet.

FIGS. 5-7 provide a detailed view of the novel clasp, referenced as 12, of the present invention. Clasp 12 includes first and first and second connectable clasp components, referenced as 20 and 22 respectively. Clasp components 20 and 22 are essentially identical mirror image components. Accordingly, identical reference numbers are used herein for identical parts thereof. Each clasp component 20 and 22 comprises a partially hollow housing formed by a main clasp body 24. Clasp components 20 and 22 are preferably conically shaped as depicted in FIG. 5, and include an end portion connected to one of the electrical conductor assemblies 14 and 16. Clasp body 24 defines an internally threaded open end 24A and an electrically conducting cap 26 in threaded engagement therewith. As seen in FIG. 12, cap 26 is externally threaded for mating threaded engagement with the internally threaded open end portion 24A of clasp body 24 as best depicted in FIGS. 6 and 7. Clasp body 24 is in removable threaded engagement with cap 26 to form a housing that contains a magnet 28 and a battery 30. Clasp body 24 is further configured for receiving an end of conductor assembly 14 (or 16) having an end fitting, referenced as 32 and depicted in FIG. 10, received within a conductor retaining sleeve 34 depicted in FIG. 11. Conductor retaining sleeve 34 further has an end of the electrical conductor assemblies 14 or 16 disposed thereon such that a radially enlarged end, referenced as 14D and 16D respectively, is formed and sandwiched between retaining sleeve 34 and main body 24 as best depicted in FIG. 8.

As best depicted in FIGS. 6, 7, 8 and 8A, each electrical conductor assembly, 14 and 16, preferably has a core conductor, referenced as 14A and 16A respectively, a plurality of stainless wires or filaments 14B/16B helically wound on conductor 14A/16A, a plastic coating 14C/16C, and a tapering helically wound outer wire 14D/16D in surrounding relation therewith. Core conductors 14A and 16A are preferably formed from a MONEL® alloy. MODEL® is a trademark of Inco Alloys International, Inc. MONEL® comprises a rustless (stainless) metal alloys primarily composed of nickel (up to 67%) and copper, with some iron and other trace elements, and thereby provides a conductor that is suitable for sodering.

A plurality of stainless wires or filaments, referenced as 14B and 16B, are preferably wrapped tightly around core conductors 14A and 16A, and provide structural strength. Stainless wires 14B and 16B function to maintain the necklace in an arcuate shape when worn and further function to prevent the conductor assembly from kinking. In addition, core conductors 14A/16A, and stainless wires 14B/16B, are externally coated with a coating of non-conductive composition, referenced as 14C/16C. Coating 14C/16C is preferably a nylon composition of approximately 0.025 inches in thickness. It should be apparent that any suitable non-conductive material is considered within the scope of the present invention.

The helically wound outer wires 14D and 16D in surrounding relation with the nylon inner conductor wires preferably taper from a larger diameter for portions thereof disposed toward the clasp end, to a smaller diameter for portions thereof disposed at the illuminated medallion end. In a preferred embodiment, helically wound wires 14D and 16D taper from a large inner diameter of approximately 0.074 inches (outer diameter of approximately 0.092 inches) at the clasp end, to a smaller inner diameter of approximately 0.028 inches (outer diameter of approximately 0.044 inches) at the illuminated end. Helically wound wires 14D and 16D are preferably fabricated from medical grade surgical stainless steel wire, such the type often used to form catheter systems. The material used for the outer wires is considered significant and is preferably selected from hypoallergenic material selections. The helically wound outer wire 14D/16D functions structurally to maintain an arcuate shape and prevent the necklace from forming a V-shape when worn. While a preferred embodiment of the present invention utilizes the conductor assembly disclosed above, it should be noted that other conductor assemblies, such as the conductor assembly disclosed above without the helical outer wires (14D and 16D), or a simple single strand copper conductor having a non-conductive outer layer, is considered within the scope of the present invention.

As illustrated in FIG. 4, illuminated necklace 10 further includes a medallion 18 adapted with a light emitting device. In a preferred embodiment, medallion comprises a transparent crystal 18B containing a miniature light emitting diode ("LED") 18A. Medallion 18 may comprise a transparent or translucent structure, or alternatively may comprise a generally opaque structure having transparent or translucent portions. Electrical power is provided to LED 18A by electrical conductor assemblies 14 and 16 that are connected thereto. An electrical circuit is completed when clasp 12 is connected such that clasp members 20 and 22 are disposed in face-to-face contacting relation as depicted in FIG. 7 More particularly, magnets 28 not only conduct electricity, but function to bias and maintain caps 26 of clasp members 20 and 22 in face-to-face relation without need for further mechanical connecting structure. The use of magnetic attachment is considered significant in providing a clasp that is easily connected by the user since the magnetic attraction between clasp members 20 and 22 help guide the clasp to the connected configuration. In addition, the user is able to undo clasp 12 by simply applying a separating force to the clasp members 20 and 22, and is thus not required to manipulate any tiny mechanical latching mechanism as commonly found on necklaces. As noted above, an electrical circuit is created when clasp 12 is connected and conducting caps 26 are in contact thereby completing an electrical circuit. Each battery 30 is preferably capable of providing a current at 1.5 Volts DC, and when clasp 12 is in the connected configuration batteries 30 are electrically connected in series so as to provide a battery output of approximately 3.0 Volts DC. As should be apparent, caps 26, magnets, 28, and conductor end fittings 32, and conductors 14 and 16, are all in electrical communication such that electrical current is allowed to flow through conductors 14 and 16 to LED 18A thereby causing illumination.

Figure 13:
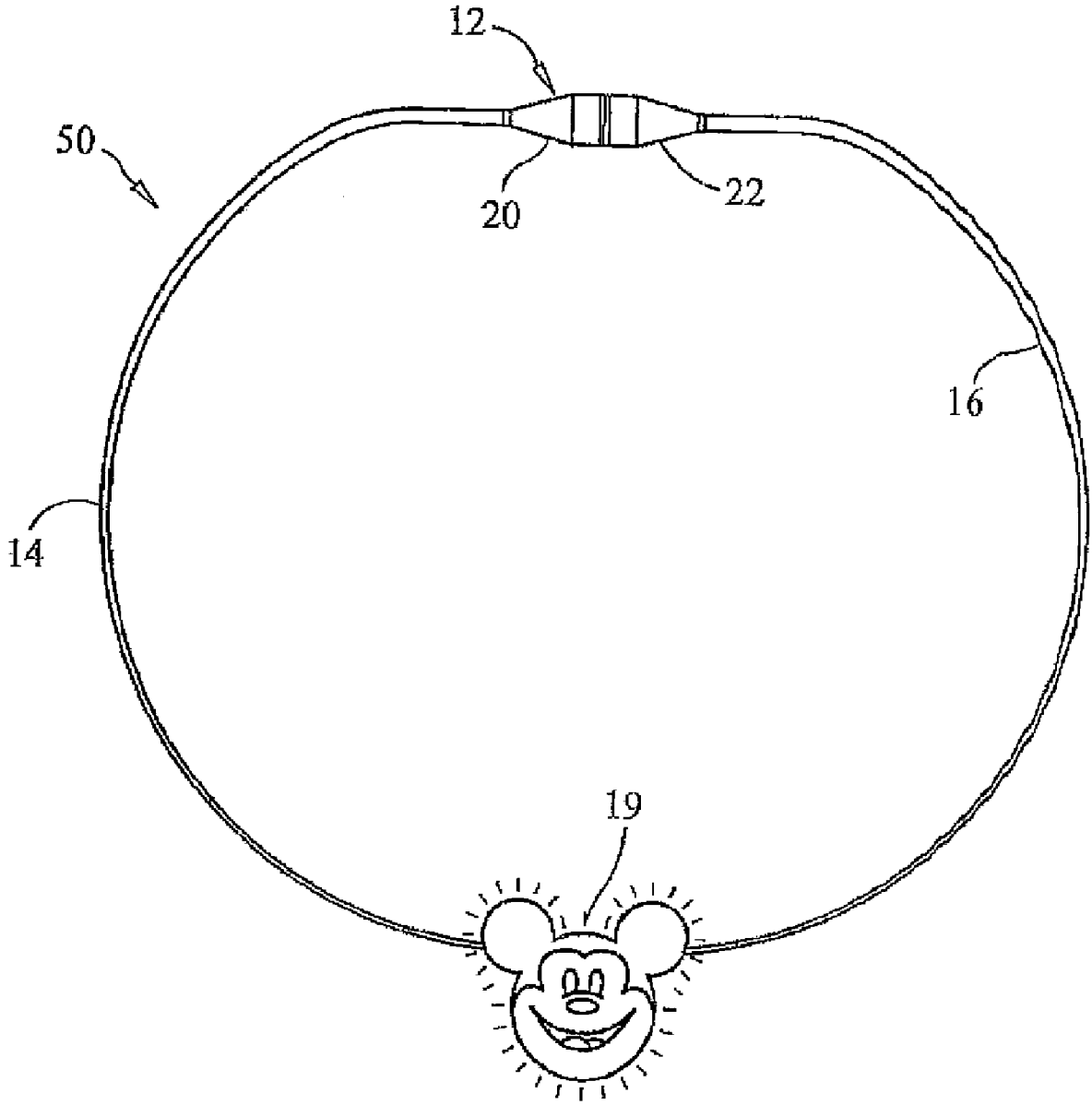
FIG. 13 depicts an alternate embodiment with an ornamental illuminated figure.

FIG. 13 depicts an alternate embodiment illuminated necklace, generally referenced as 50. Necklace 50 includes the magnetic clasp 12, having magnetically connectable clasp ends 20 and 22, and conductor assemblies 14 and 16. In addition, necklace 50 includes an alternate medallion, namely a figurine 19 having the design of a popular character. As with the previously disclosed embodiment, figurine 19 includes a transparent or translucent body 19A containing a LED electrically connected to clasp 12. As should now be apparent, the present invention may be adapted with an illuminating medallion of any suitable shape or structure.

FIGS. 14-27 depict an alternate embodiment clasp component, referenced as 100. Clasp component 100 includes a clasp body 110 having a projecting tip 112 defining a through bore 114. Clasp body 110 further defines an annular recessed groove 116 disposed in proximity to tip 112 and in surrounding relation therewith. Tip 112 functions to receive the conductor assembly 14 or 16 such that conductors 14A/16A may be insertedly received within through bore 114 for electrical connection to a battery as further discussed below. Recessed groove 116 functions to receive an end portion of helical outer wire 14D insertedly received therein in a connection configuration. Tip 112 projects from clasp body 110 so as to support helical outer wire 14D from within thereby preventing radial deformation when grasped by the user. This aspect her provides ergonomic benefits making the outer wire radially rigid thereby providing an ergonomic structure for grasping while manipulating the clasp. Clasp body 110 further defines a radial aperture 118 disposed in generally perpendicular relation with through bore 114. Radial aperture 118 functions to receive a self-tapping threaded fastener 118A therein. Fastener 118A functions to secure conductor assemblies 14 and 16 relative to clasp component 100 by engagement therewith.

Figure 14:
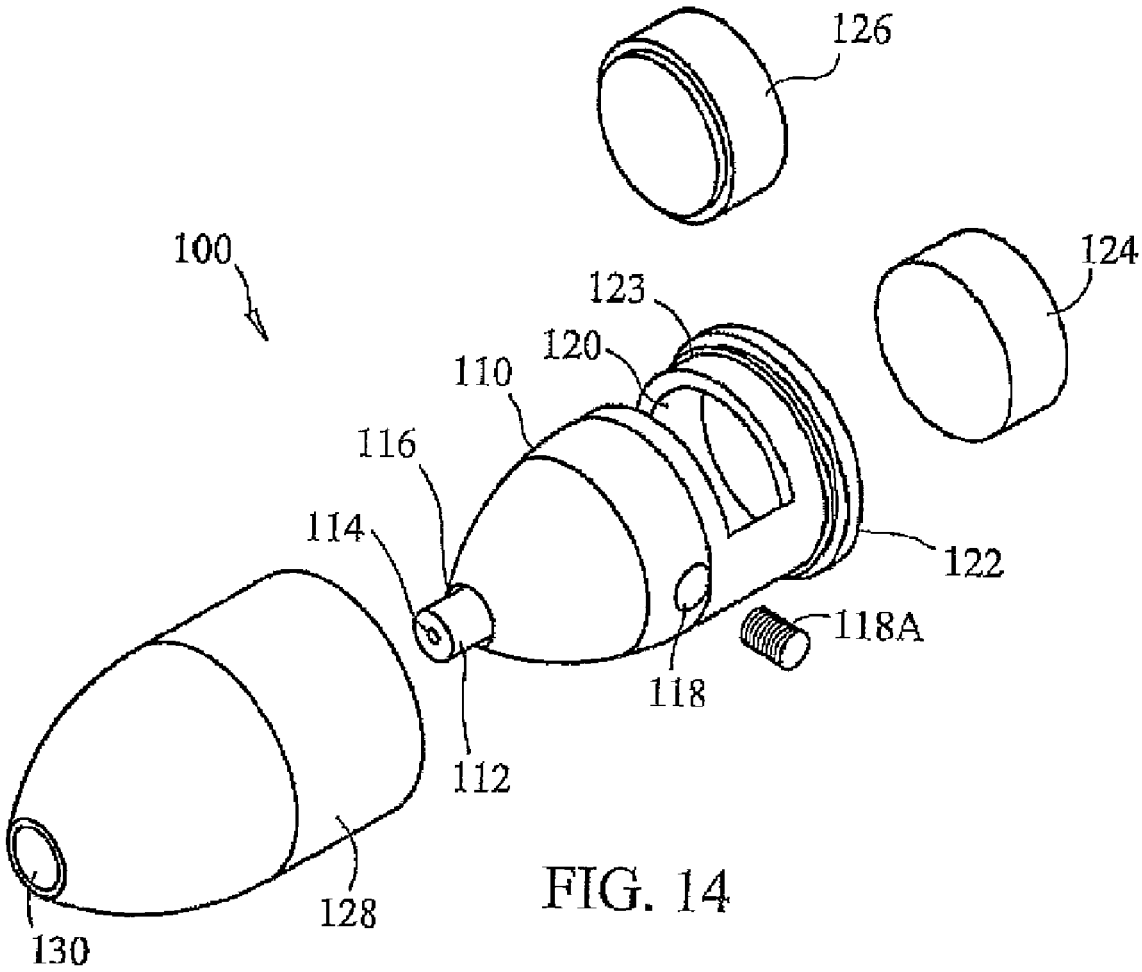
FIG. 14 is an exploded view of an alternate embodiment clasp component assembly.
Figure 15:
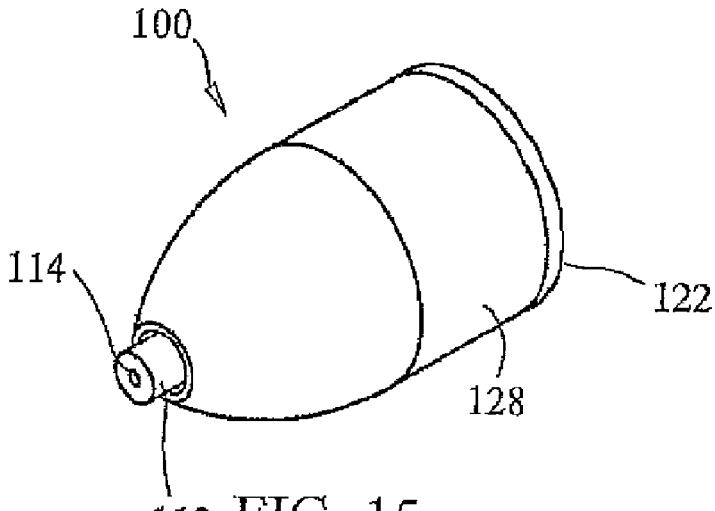
FIG. 15 is a perspective view thereof.
Figure 17:
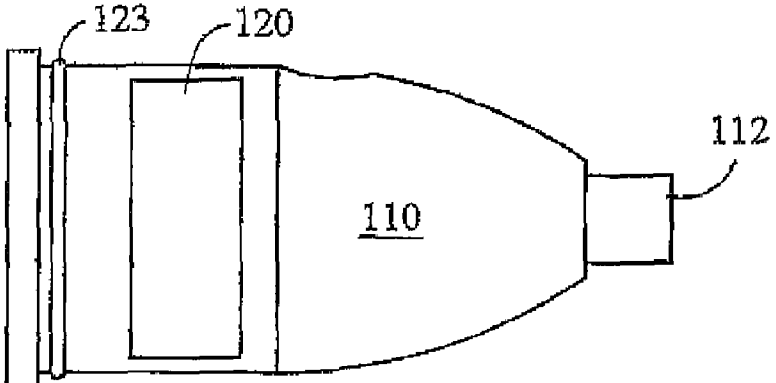
FIGS. 16-18 are side views of the alternate embodiment clasp component.
Figure 19:
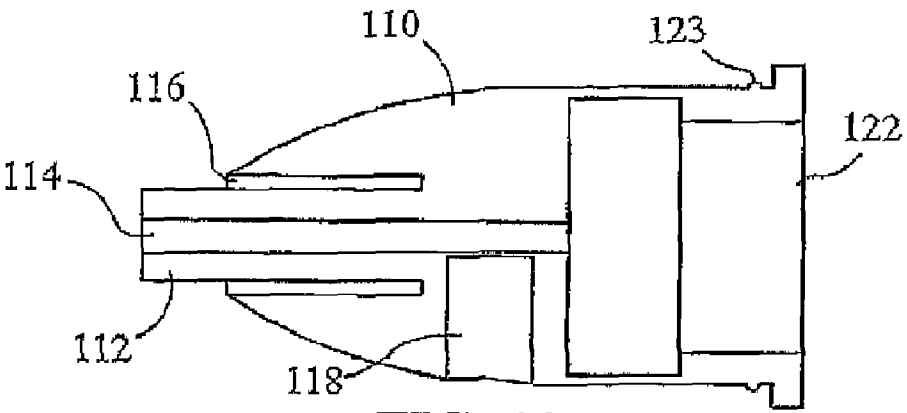
FIG. 19 is a sectional view thereof taken along section line A-A of FIG. 18.
Figure 16:
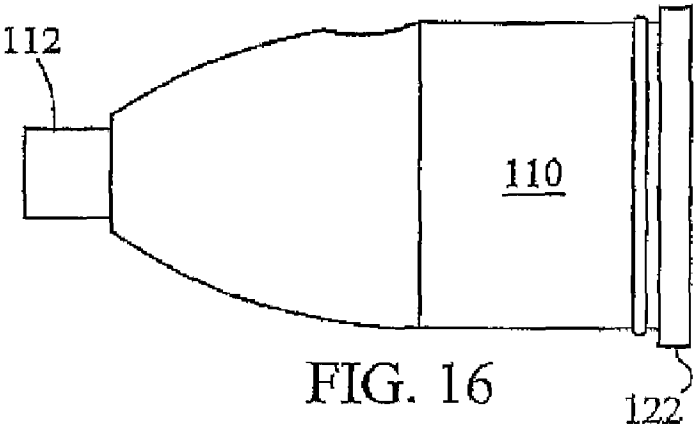
Figure 18:
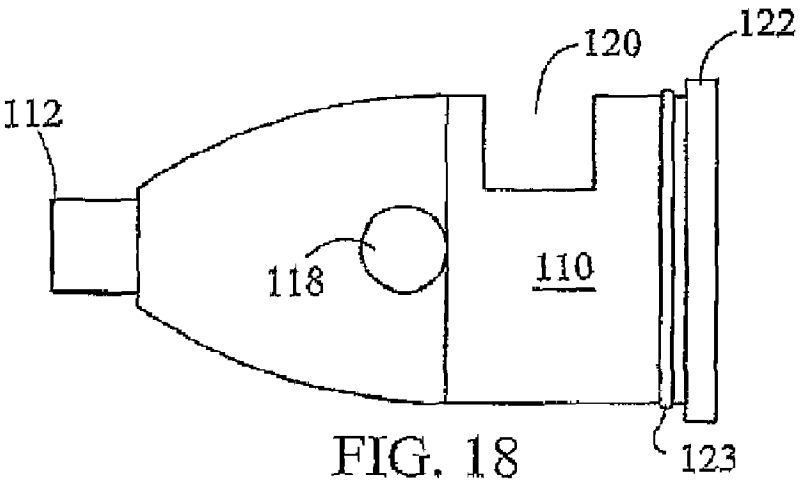
Figure 21:
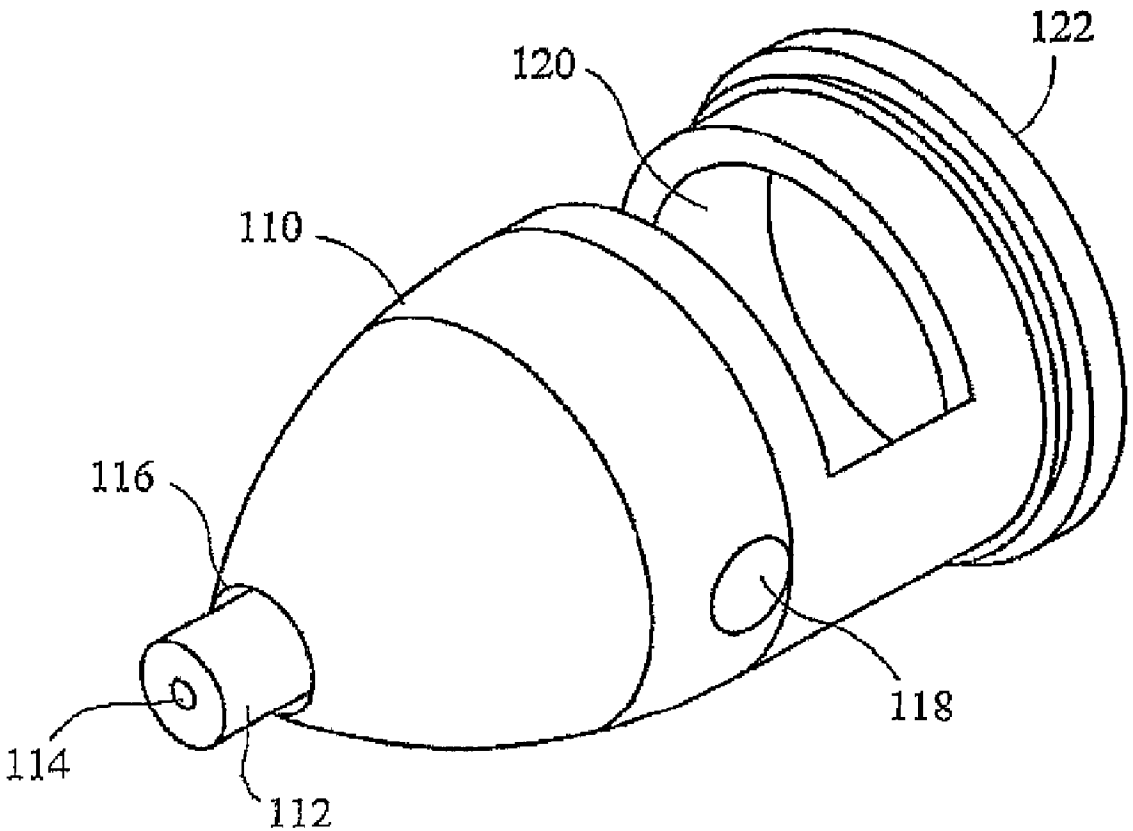
FIG. 21 is a perspective view thereof.
Figure 20:
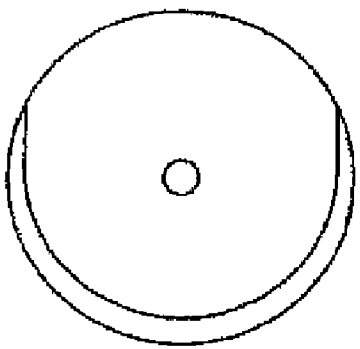
FIG. 20 is a sectional view thereof taken along section line B-B of FIG. 18.
Figure 24:
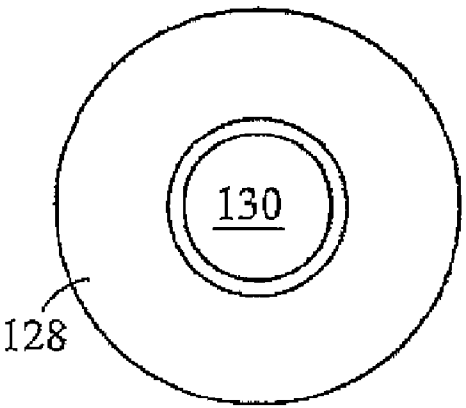
FIG. 24 is a front view thereof.
Figure 22:
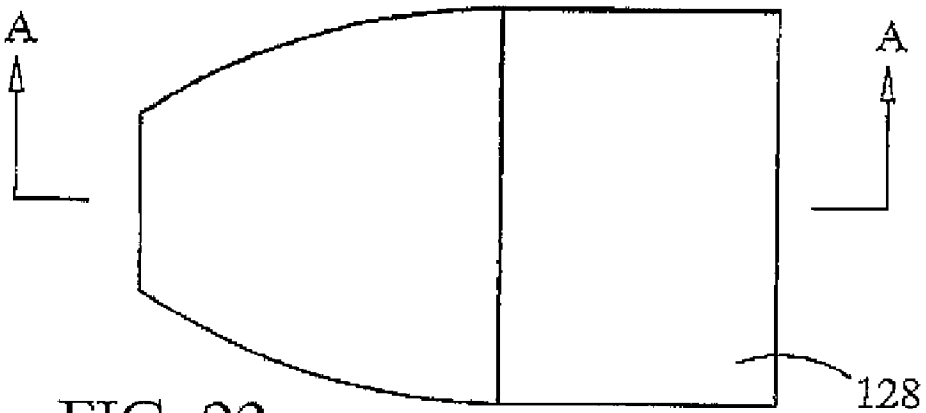
FIG. 22 is a side view of a clasp cover.
Figure 23:
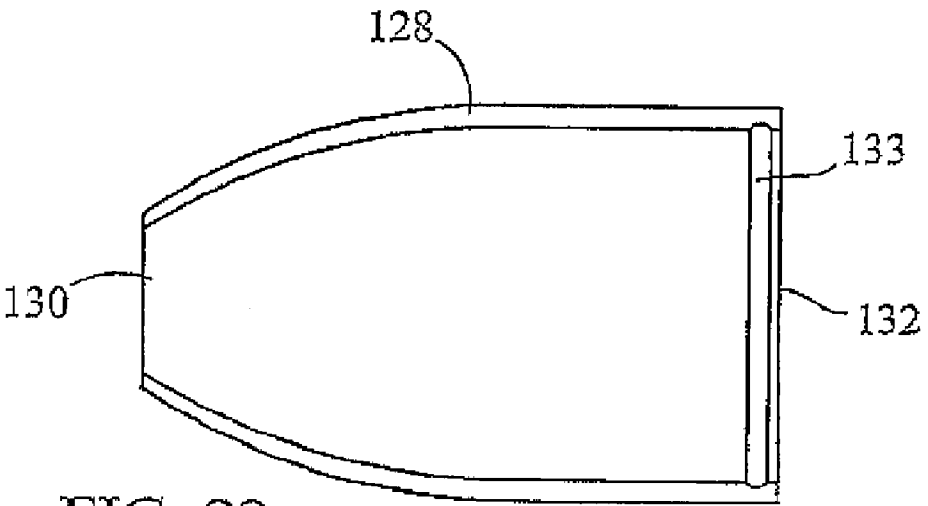
FIG. 23 is a sectional view thereof taken along section line A-A of FIG. 22.
Figure 25:
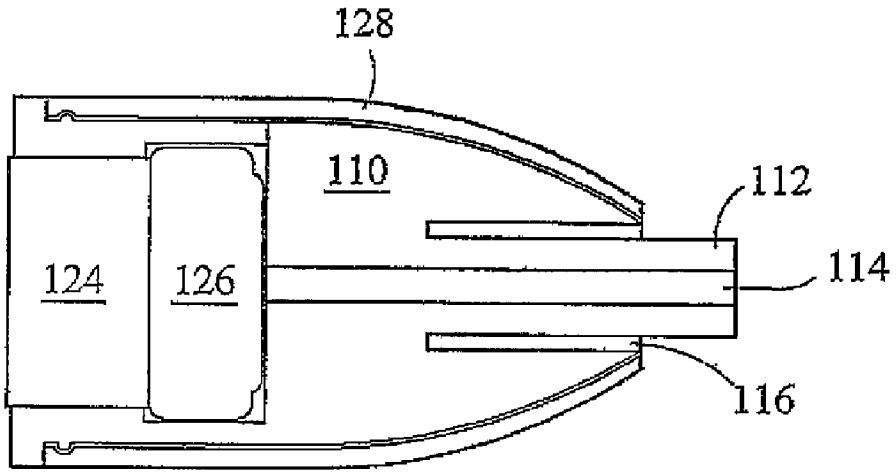
FIG. 25 is a sectional view of an assembled clasp component taken along section line A-A of FIG. 26.
Figure 26:
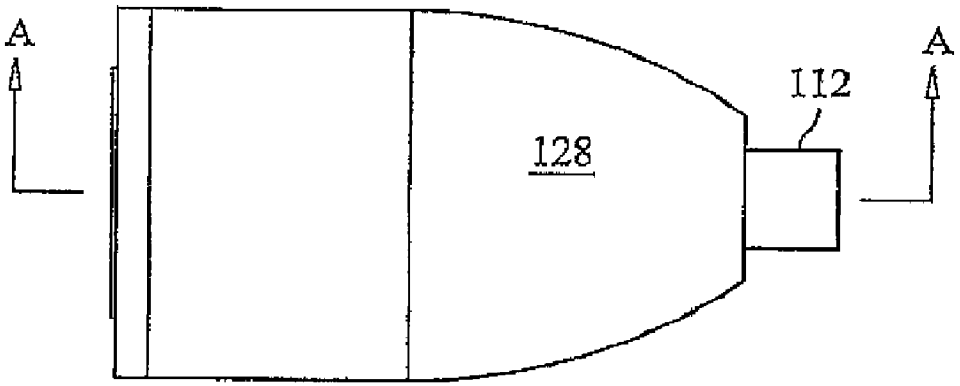
FIG. 26 is a side view of the assembled clasp.
Figure 27:
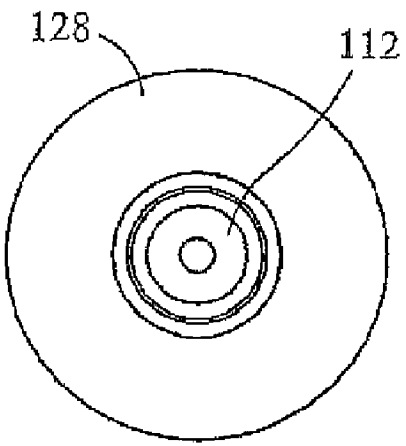
FIG. 27 is an end view thereof.

Clasp body 110 further defines a sidewall opening 120 and an end opening 122. Sidewall opening 120 is sized to provide for insertion of a battery 126 into clasp body 110, and end opening 122 is sized for receiving a magnet 124 inserted therein. Once battery 126 and magnet 124 are installed a cover, referenced as 128, is placed in covering relation with clasp body 110, as best illustrated in FIGS. 14 and 15. Cover 128 defines open ends 130 and 132. Open end 130 functions to allow tip 112 to project through cover 128. Open end 132 functions to receive clasp body 110 insertedly therein and terminates proximal end 122 of clasp body 110 when installed thereon. Clasp body 110 further includes a radially outwardly projecting circumferential lip 123, that engages a corresponding radially inwardly recessed circumferential groove 133 proximal cover end 132, which structures function to provide a detachable snap-fit connection between clasp body 110 and cover 128 as best seen in FIG. 25. As further seen in FIG. 25 magnet 124 and battery 126 fit within internal chambers defined by clasp body 110. In a preferred embodiment, magnet 124 is exposed at the base of clasp body 110. As further depicted through bore 114 provides a conduit for connection of an electrical conductor to battery 126. Battery 126 may be removed and replaced by removing cover 128, removing battery 126 through clasp body opening 120, installing a new battery, and replacing cover 128 into snap-fit engagement with clasp body 110.

Figure 28:
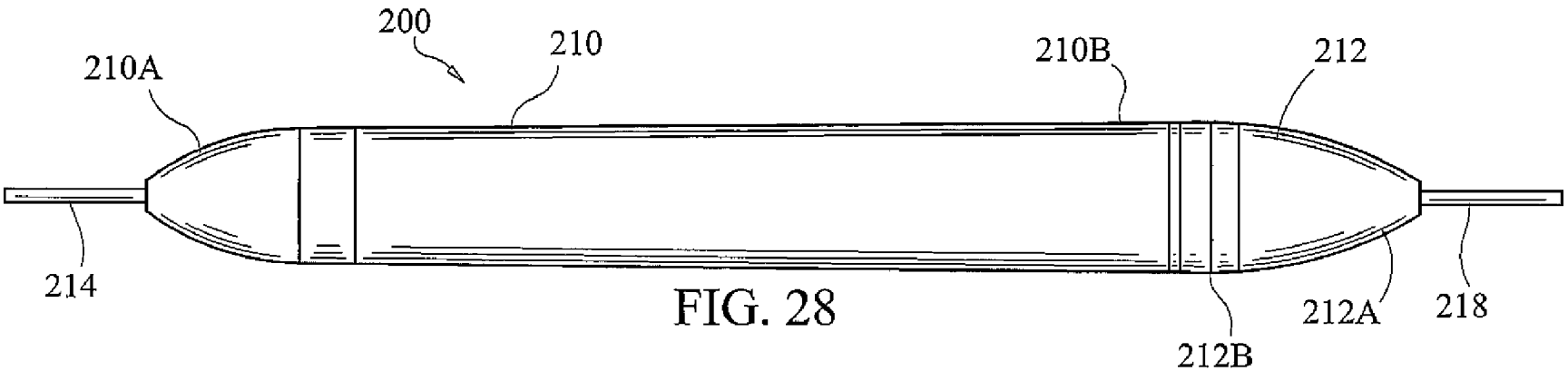
FIG. 28 is a side view of an alternate embodiment clasp assembly.
Figure 29:
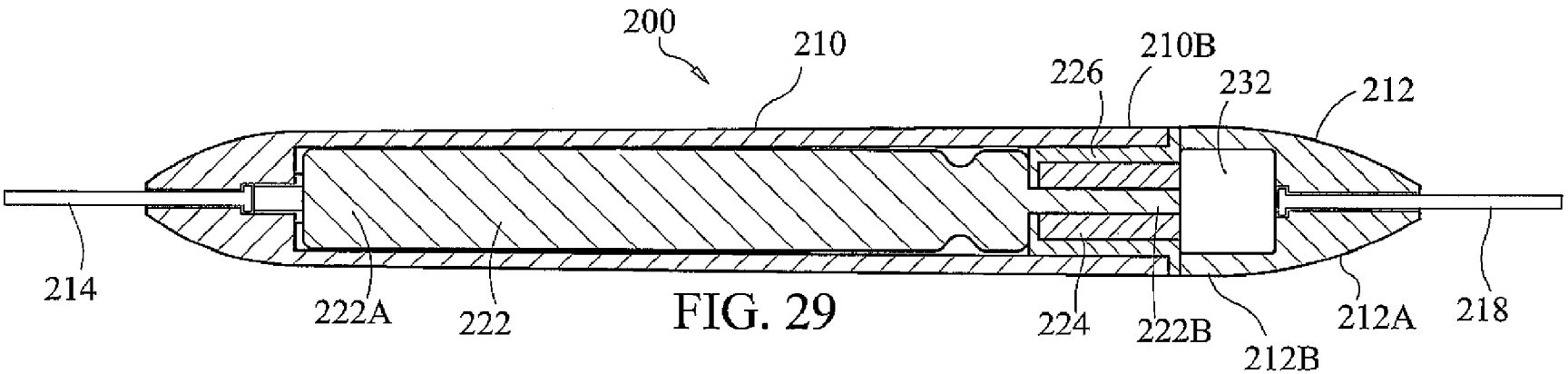
FIG. 29 is a side sectional view thereof.
Figure 31:
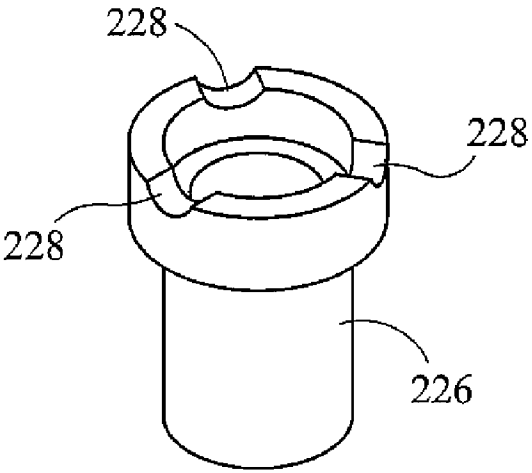
FIGS. 30-33 depict a detailed view of clasp insert having circumferentially spaced recesses.
Figure 33:
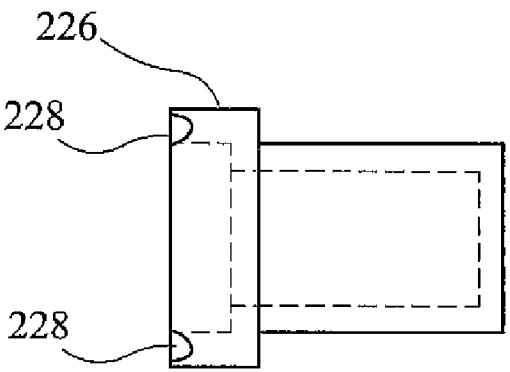
Figure 30:
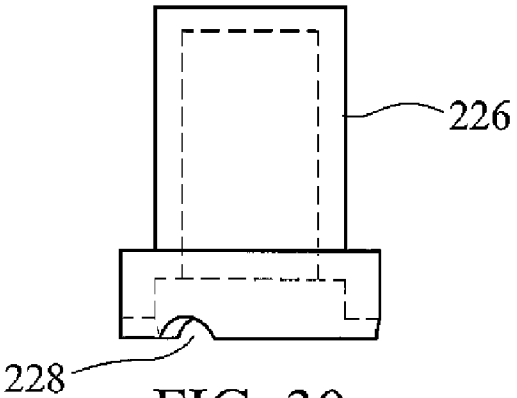
Figure 32:
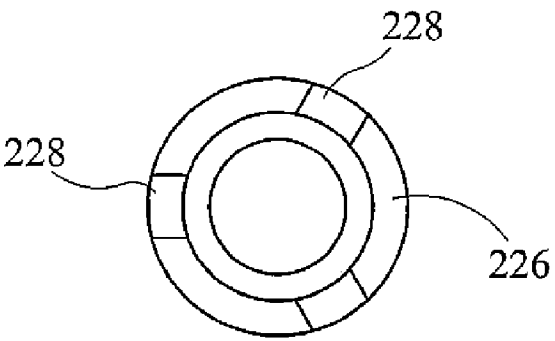
Figure 34:
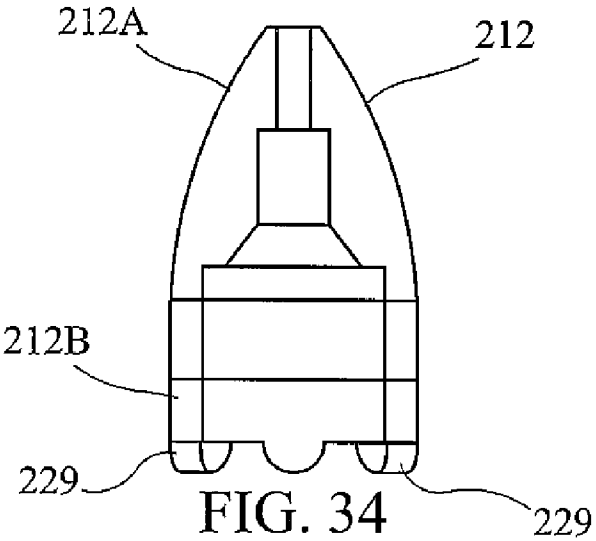
FIGS. 34-36 depict a detailed view of a clasp component adapted with protuberances corresponding to the recesses defined by the clasp component depicted in FIGS. 30-33.
Figure 35:
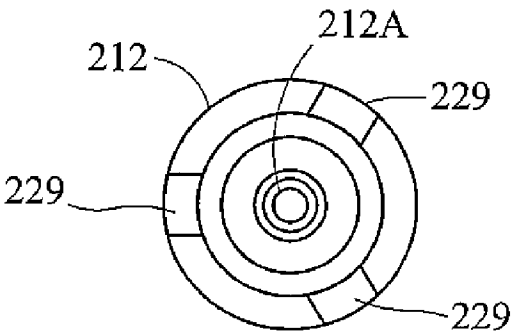
Figure 36:
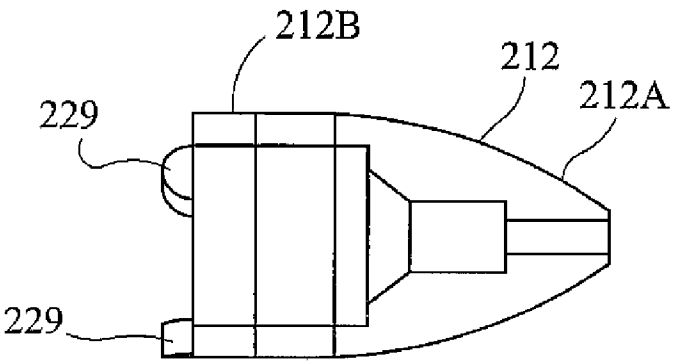

FIGS. 28-36 depict an alternate clasp assembly, generally referenced as 200, in accordance with the present invention. As best seen in FIGS. 28 and 29, clasp assembly 200 includes first and first and second magnetically connectable clasp components, referenced as 210 and 212 respectively. When in a connected configuration, clasp components 210 and 212 essentially form a generally cylindrical clasp having tapered opposing ends from which electrically conducting flexible members, referenced as 214 and 218, project. Each clasp component 210 and 212 comprises a partially hollow housing. Clasp components 210 and 212 are preferably generally cylindrically shaped with generally planar shaped first ends and generally conically shaped opposing second ends from which electrical conductor assemblies 214 and 218 respectively project as illustrated in FIG. 28. In this alternate embodiment, clasp component 210 is preferably longer in length as compared with clasp component 212 such that sufficient space is made available therein to form an internal battery compartment.

Clasp component 210 comprises a generally hollow cylindrical body having a tapered end 210A and an open end 210B. Tapered end 210A defines an axial through bore through which an electrical conductor 214 passes. Conductor 214 terminates and an electrically conducting end fitting 215 having a radially enlarged flanged head that maintains the conductor end received within the tapered end 210A of clasp component 210. A helical coil spring 216 may be disposed in surrounding relation with a portion of end fitting 215 to provide a spring biased force for maintaining end fitting 215 in contact with a battery 222. Battery 222 preferably includes a generally cylindrical main body 222A and an axially projecting conductor 222B on one end thereof as best illustrated in FIG. 29. A generally cylindrical magnet 224 defines an axial through bore for receiving projecting conductor 222B of battery 222, such that magnet 224 is disposed in surrounding relation with battery conductor 222B adjacent open end 210B of clasp component 210. Magnet 224 functions to maintain clasp components 210 and 212 in magnetic engagement (e.g. magnetically connected). An insert 226 is disposed in engagement with the open end 210B of clasp component 210. Insert 226 is preferably fabricated from an electrically non-conductive material, and may engage the open end 210B via snap fit, press fit, threaded engagement or any other suitable connection configuration. As best seen in FIGS. 30-33, insert 226 further includes a flanged end defining three concave recesses 228, generally angularly spaced 120-degrees, that function along with corresponding convexly projecting protuberances 229 formed on the adjacent face of clasp component 212, to provide an electrically "on/off" switching function when clasp 200 is in the magnetically connected configuration as more fully disclosed herein. The structure and function of a magnetic clasp for illuminated articles, such as jewelry, having simple on/off switching configurations when in the clasped configuration is considered a significant aspect of the present invention.

Clasp component 212 comprises a generally hollow cylindrical body having a tapered end 212A and an open end 212B. Open end 212B includes projecting protuberances 229 sized and shaped for received mating engagement with concave recesses 228 on insert 226 of clasp component 210. Tapered end 210A defines an axial through bore through which an electrical conductor 218 passes. Conductor 218 terminates and an electrically conducting end fitting 228 having a radially enlarged flanged head that maintains the conductor end received within the tapered end 212A of clasp component 212. In addition to providing magnetic attraction for clasp connection, magnet 230 functions as an electrical conductor. Clasp component 212 further includes convexly projecting protuberances 229 formed on end 212B to provide an electrically "on/off" switching function when clasp 200 is in the magnetically connected configuration as more fully discussed below.

As should now be apparent, clasp 200 comprises a magnetically connectable clasp configurable to a magnetically connected configuration as shown in FIGS. 28 and 29 wherein an electrical circuit is completed for illumination of an electrically connected LED pendant as disclosed above. In this configuration projecting conductor 222B is placed in electrical communication clasp member 212 via contact with magnet 232 thereby completing/activating an electrical circuit. The present invention thus achieves double duty from magnet 232, namely the combination of functioning as a magnet as well as an electrical A significant aspect of the present embodiment includes providing a magnetically connectable clasp that is configurable between electrically "on" and "off" configurations when in a magnetically connected configuration. In the activated, or "on", configuration clasp components 210 and 212 are configured such that projecting protuberances 229 on clasp component 212 are received within corresponding recesses 228 of insert 226 of clasp component 210. In this configuration the clasp is magnetically connected such that clasp components 210 and 212 are in electrical contact with magnets 224 and 232 are in physical contact and the post end 222B of battery 222 in clasp component 210 in physical contact with magnet 232 in clasp component 212. Clasp 200 may further be configured in a magnetically connected, but electrically deactivated, or "off", configuration by twisting component 210 relative to component 212 such that protuberances 229 of clasp component 212 are not seated within recesses 228 formed on insert 226 of clasp component 210. When protuberances 229 are not seated within recesses 228, the protuberances function as spacers that separate the clasp components 210 and 212 thereby breaking the electrical circuit while still maintaining magnetic connection of clasp components 210 and 212. It has been found that use of three protuberances 229 is preferred as the three function as legs forming a stable tripod mounting configuration that maintains the clasp magnetically connected but electrically deactivated. This configuration allows the user to wear the illuminated jewelry in a non-illuminated electrical state to conserve battery life.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An article of adornment comprising:

a generally flexible electrical conductor assembly;

said conductor assembly forming a loop having first and second internal discontinuities;

a clasp located within said first discontinuity and electrically connected to said conductor assembly;

said clasp adapted to receive at least one battery;

a light emitting device located within said second discontinuity and electrically connected to said conductor assembly;

said clasp including first and second clasp members configurable between a magnetically connected configuration and a disconnected configuration;

said clasp including at least one magnet, said magnet functioning to releasably maintain said clasp in said magnetically connected configuration;

said clasp configurable to an electrically activated configuration, wherein an electrical circuit is activated causing illumination of said light emitting device, when in said magnetically connected configuration; and means for electrically deactivating the electrical circuit with said clasp in the magnetically connected configuration.

2. An article of adornment according to claim 1, wherein said light emitting device comprises a light emitting diode.

3. An article of adornment according to claim 1, wherein said means for electrically deactivating the electrical circuit includes means for separating said first and second clasp members by rotating one of said clasp members relative to the other clasp member whereby said electrical communication between said first and second clasp members is terminated.

4. An article of adornment according to claim 3, wherein said means for separating said first and second clasp members includes a plurality of protuberances on said first clasp member and a corresponding plurality of recesses on said second clasp member, whereby said an electrical circuit is activated when said protuberances are received within said recesses and the electrical circuit is deactivated when said protuberances are dislodged from said recesses.

5. An article of adornment according to claim 1, wherein said clasp includes at least one magnet that functions as an electrical conductor.

6. An article of adornment comprising:

a generally flexible conductor assembly;

said conductor assembly forming a loop having first and second internal discontinuities;

a clasp located within said first discontinuity, said clasp including first and second clasp members, each clasp member electrically connected to said conductor assembly;

at least one of said clasp members containing a battery;

at least one of said clasp members including a magnet that functions to releasably maintain said first and second clasp members in a magnetically connected configuration;

a light emitting device located within said second discontinuity and electrically connected to said conductor assembly;

said clasp being configurable in said magnetically connected configuration between an electrically activated configuration wherein said light emitting device is illuminated, and an electrically deactivated configuration wherein said light emitting device is not illuminated.

7. An article of adornment according to claim 6, wherein said light emitting device comprises a light emitting diode.

8. An article of adornment according to claim 6, wherein configuring said clasp to said electrically deactivated configuration includes terminating electrical communication between said first and second clasp members by rotating one of said clasp members relative to the other clasp member whereby said electrical communication between said first and second clasp members is terminated.

9. An article of adornment according to claim 8, further including a plurality of protuberances on said first clasp member and a corresponding plurality of recesses on said second clasp member, whereby electrical communication between said first and second clasp members is established when said protuberances are received within said recesses, and the electrical communication is not established when said protuberances are dislodged from said recesses.

10. An article of adornment according to claim 6, wherein said at least one magnet functions as an electrical conductor.

* * * * *